US006161222A

United States Patent [19]

Strickland et al.

[11] Patent Number: 6,161,222

[45] Date of Patent: Dec. 19, 2000

[54] ATHLETIC GARMENT WITH INNER THIGH GUARDS

[76] Inventors: D. Chad Strickland, 2421 Grapevine, Midwest City, Okla. 73130; Mark T. Cheatwood, 3915 Westbrook Dr., Stillwater, Okla. 74074

[21] Appl. No.: 09/415,324

[22] Filed: Oct. 8, 1999

[51] Int. Cl.[7] ..... A41D 1/00

[52] U.S. Cl. ..... 2/228; 2/238; 2/455; 2/456; 2/466

[58] Field of Search ..... 2/228.79, 227.8, 2/238.69, 455, 456, 466, 23, 24; 602/2, 13, 62; 450/100, 101, 98, 99

[56] References Cited

U.S. PATENT DOCUMENTS

| | | | |
|---|---|---|---|
| 759,833 | 5/1904 | Stall | 2/455 |
| 4,035,844 | 7/1977 | Atack et al. . | |
| 4,577,346 | 3/1986 | Hall . | |
| 4,811,427 | 3/1989 | Regan . | |
| 4,922,899 | 5/1990 | Graff et al. . | |
| 4,969,216 | 11/1990 | Guelli . | |
| 5,123,407 | 6/1992 | Dewhurst | 602/2 |
| 5,134,726 | 8/1992 | Ross . | |
| 5,274,854 | 1/1994 | Wenner et al. . | |
| 5,377,693 | 1/1995 | Loper et al. | 2/455 X |
| 5,572,737 | 11/1996 | Valice | 2/465 |

*Primary Examiner*—Gloria M. Hale
*Attorney, Agent, or Firm*—Mary M. Lee

[57] ABSTRACT

An athletic garment with protective guard members on the inner thighs. The garment preferably will be compression shorts or pants. The guard members are supported in pockets formed on the inside of each thigh portion of the shorts. The guard member preferably is adapted to both deflect impacts and to absorb shock from impacts, particularly from balls in sports such as baseball. The guard member preferably is formed of an inner flexible, hard plastic deflective layer and an outer flexible, shock absorbing foam layer. Thus, the garment of this invention is particularly suited for use by a baseball catcher and the other infielders, but will be useful to athletes in any sport. This protective garment will reduce the discomfort and injury caused by the impact of a ball or other equipment or objects employed in virtually any sports activity.

20 Claims, 2 Drawing Sheets

ATHLETIC GARMENT WITH INNER THIGH GUARDS

FIELD OF THE INVENTION

The present invention relates generally to athletic garments with protective padding.

BACKGROUND OF THE INVENTION

The most dangerous positions in baseball are infielders, which include the catcher position. When an infielder is in the fundamental ready position he or she is especially vulnerable to injury in the inner thighs. Those playing the position of catcher are particularly subject to such injuries. The catcher must crouch or squat immediately behind the plate with his or her knees apart while the ball is being thrown directly over the plate at the catcher. Consequently, the ball often hits the catcher either because the batter misses the on-coming ball entirely or because the bat only deflects the ball. To protect against injuries, catchers wear a variety of protective gear including helmets, masks, chest plates, cups and shin and knee guards. However, there remains a need to protect the inner thighs of infielders and especially the catcher, as this body area is exposed when these players are in the fundamental ready position.

SUMMARY OF THE INVENTION

The present invention is directed to an athletic garment. The garment comprises a body including a pair of thigh portions. The garment further comprises a pair of guard members, one supported by each of the thigh portions over the inner thigh when the garment is worn.

DETAILED DESCRIPTION OF THE PREFERRED EMBODIMENT

Figure 1:
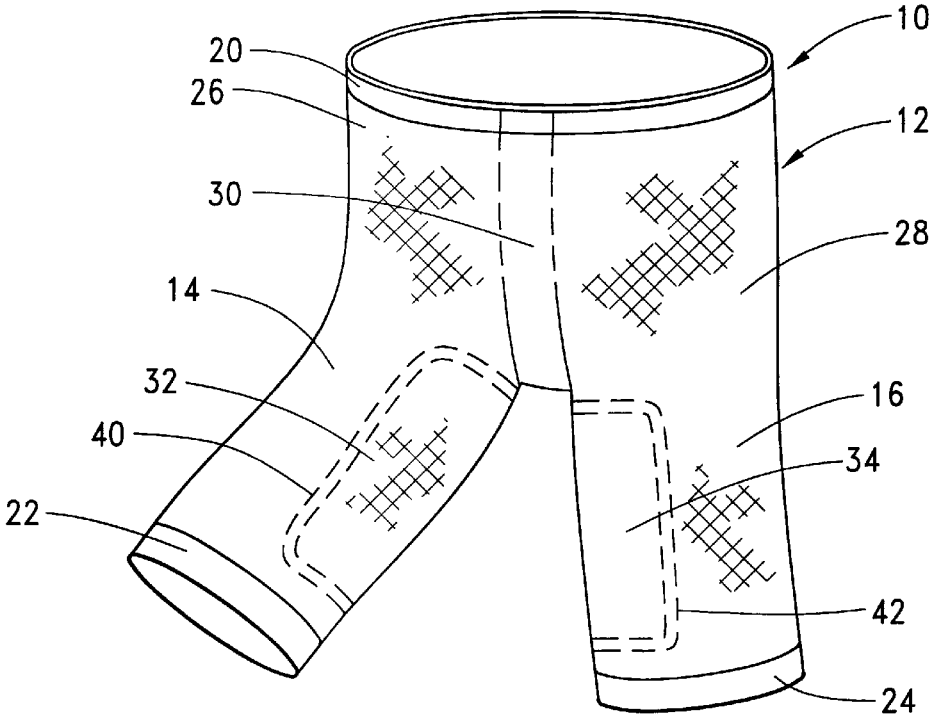
FIG. 1 shows a front perspective view of an athletic garment made in accordance with the present invention.
Figure 2:
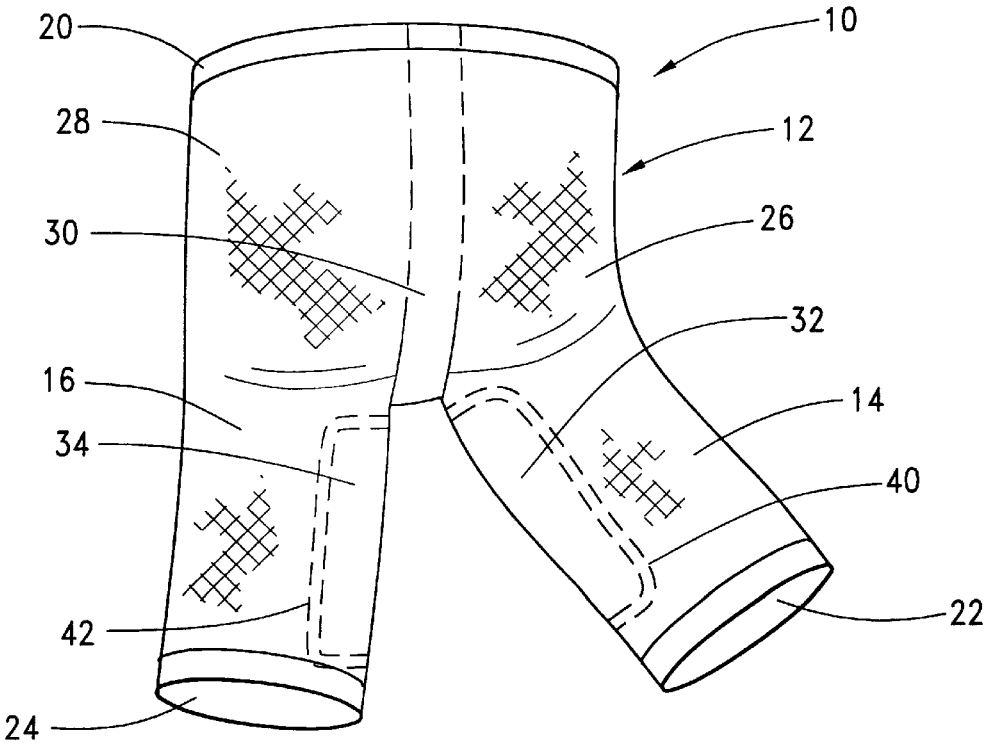
FIG. 2 shows a rear view of the athletic garment shown in FIG. 1.

Turning now to the drawings in general and to FIGS. 1 and 2 in particular, there is shown therein an athletic garment made in accordance with the present invention and designated generally by the reference numeral 10. In the embodiment illustrated, the garment 10 is a pair of shorts, however the garment could take the form of long pants or any other item of apparel that include a portion that covers the thighs. Preferably, the garment is a pair of compression shorts made of a blend of nylon and Lycra® spandex material, or some other highly elastic, washable and durable fabric. However, the garment may be formed of virtually any material, elastic or otherwise. While particularly suitable for baseball players in the position of catcher and other infielders, the protective garment of this invention will be useful by athletes in other sports as well, including but not limited to football, soccer and hockey, for example.

The garment 10 comprises a body portion 12 including a pair of thigh portions 14 and 16. In most instances, the body portion 12 will have a waistband 20 and the thigh portions will have hems 22 and 24. More preferably, the body portion 12 will comprise a pair of side portions 26 and 28, continuous with the thigh portions 14 and 16, respectively, the side portions being joined by a crotch portion 30.

The garment 10 further comprises a pair of guard members such as the pads 32 and 34. The pads 32 and 34 are supported by the thigh portions 14 and 16 over the respective adjacent inner thighs of the wearer when the garment is worn. As used herein, "inner thigh" refers to the medial aspect of the thigh, that is, the area generally between the front and back of the leg and between the knee and groin. This is to be distinguished from the frontal aspect of the thigh.

Preferably, the pads 32 and 34 are flexible so that they will conform to the shape of the thigh and bend when the wearer moves. More preferably, the pads 32 and 34 are shock absorbing in order to absorb at least part of the impact of a ball or other blow to the inner thigh during sports activities. Still further, it is desirable if the pads 32 and 34 are deflective so that blows from balls and the like will be deflected away from the thigh area.

Figure 3:
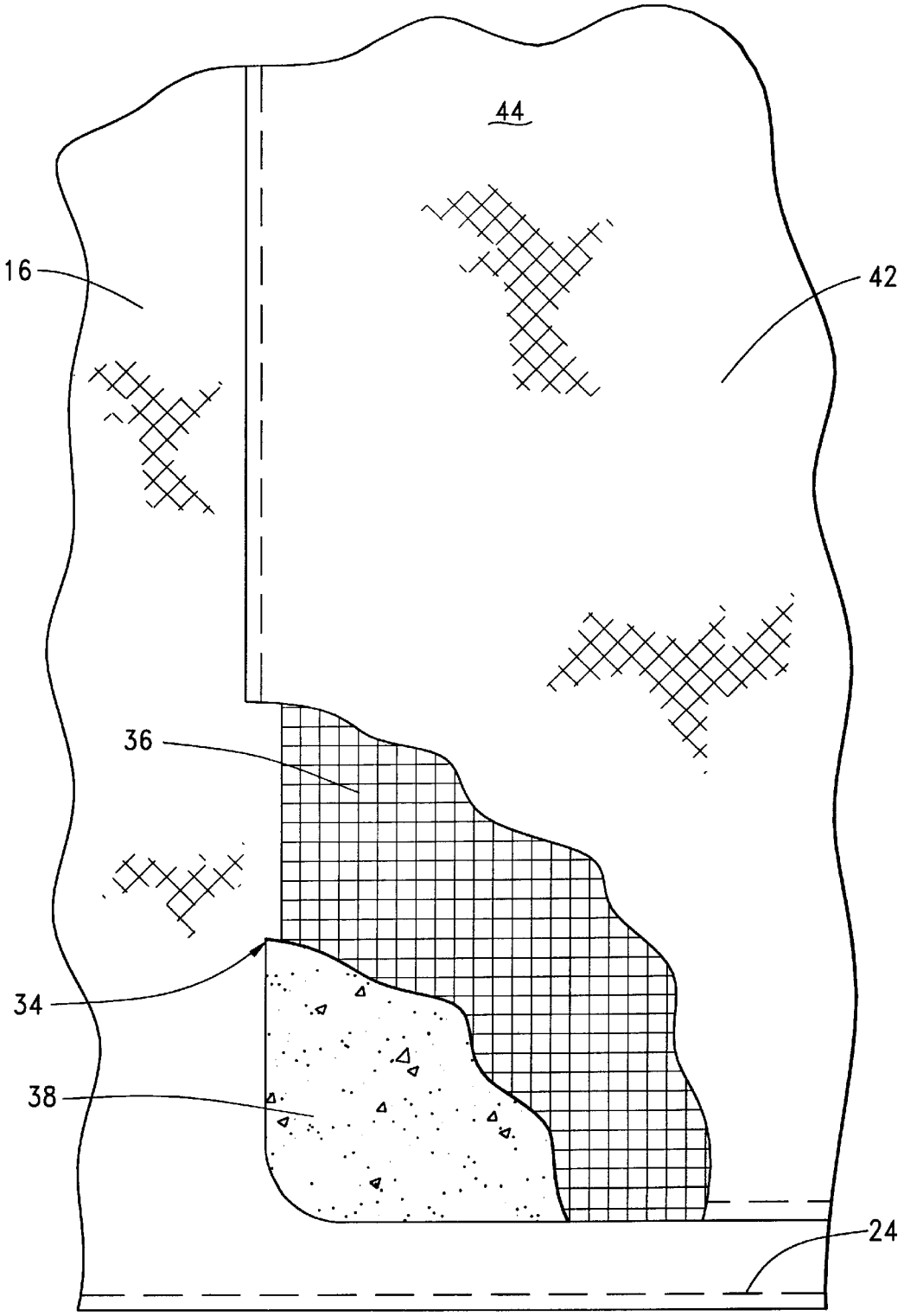
FIG. 3 shows an enlarged, partially cutaway view of the protective pad supported on the inside of each of the thigh portions of the garment.

FIG. 3 illustrates a preferred structure for the pads 32 and 34. As the pads 32 and 34 are identically formed, only the pad 34 is shown and described in detail. The pad 34 preferably is formed of a first deflective layer 36 and a second shock absorbing layer 38. The first layer 36 preferably is flexible, or bendable, so that it can be curved to conform to the contour of the thigh, and also dense or hard enough to deflect at least a portion of the impact. More preferably, the first layer 36 is highly porous and lightweight. Even more preferably, the first layer.36 is made of a non-elastic, flexible, hardened pliant substance, such as plastic. It may take the form of a grid or lattice, as shown; this makes the first layer 36 lightweight, flexible and washable, resistant to crumpling or folding, and capable of deflecting at least some of the impact of a blow from a ball or other object. Alternatively, the deflective layer 36 may be a solid sheet.

The second layer 38 preferably is a relatively compressible medium such as dense foam, which is shock absorbent and also washable. In most instances, the first layer 36 will be under the second layer 38, that is, nearer the thigh of the wearer.

As indicated, the pads 32 and 34 are supported over the inner aspect of the thigh. To this end, the garment 10 may be formed with pouches or pockets 40 and 42. Usually, the pockets 40 and 42 will be formed on the inside of the thigh portions 14 and 16; however, a similar protective effect would be achieved by supporting the pads 32 and 34 on the outside of the garment 10.

The pockets 40 and 42 may be simply provided by stitching a piece of fabric 44 (shown only in FIG. 3) slightly larger than the pads 32 and 34 on the side of the thigh portions 14 and 16 of the garment 10. This fabric 44 should be washable, absorbent and non-abrasive, as it will directly contact the skin. As thus constructed, the pocket 44 is formed by stitching or otherwise adhering the edges of the fabric 44 on the inside of the thigh portion 16 with the first layer 36 and the second layer 38 sandwiched therebetween.

It will be apparent now that in some cases, it may be advantageous to leave a portion of the pockets open so that the pads can be removed. To that end, each pocket could be provided with a zippered, hook and latch, buttoned or flapped closure. However, in the preferred embodiment the pads and are not removable.

Now it will be appreciated that the garment of the present invention provides athletes with protection not heretofore available. Conventional compression shorts or pants can be provided with protective pads for the inner thighs to protect athletes in general and baseball catchers in particular against injuries to this especially vulnerable and tender area of the body. The pads can be removably or non-removably supported on the inside or outside of the thigh portion of the pants or shorts. When constructed of the materials described herein, the garment is washable and durable as well.

Changes can be made in the combination and arrangement of the various parts and elements described herein without departing from the spirit and scope of the invention as defined in the following claims.

What is claimed is:

1. An athletic garment for a person having adjacent inner thighs, the garment comprising:

a body including a pair of thigh portions each with an inner thigh area; and a pair of guard members, one supported by each of the inner thigh areas and positioned to substantially cover the adjacent inner thighs of the wearer when the garment is worn, wherein the guard members are substantially flush with the garment and wherein the inner thigh areas of the garment comprising the guard members are not substantially thicker than the remainder of the thigh portions of the garment.

2. The garment of claim 1 wherein the garment is a pair of shorts.

3. The garment of claim 1 wherein the body of the garment is formed of elastic material.

4. The garment of claim 3 wherein the garment is a pair of shorts.

5. The garment of claim 1 wherein the guard members are shock absorbent.

6. The garment of claim 1 wherein the guard members are deflective.

7. The garment of claim 6 wherein the guard members are shock-absorbent.

8. The garment of claim 1 wherein the guard members are supported within pockets formed on the inner thigh areas of the body.

9. The garment of claim 8 wherein the guard members are non-removably supported in the pockets.

10. The garment of claim 1 wherein each guard member comprises a deflective layer.

11. The garment of claim 10 wherein each guard member further comprises a shock-absorbing layer.

12. The garment of claim 11 wherein the deflective layer is flexible.

13. The garment of claim 12 wherein the shock-absorbing layer is flexible.

14. The garment of claim 13 wherein the deflective layer is plastic.

15. The garment of claim 14 wherein the shock-absorbing layer is compressible.

16. The garment of claim 15 wherein the shock-absorbing layer is foam.

17. The garment of claim 16 wherein in each guard member the deflective layer is under the compressible layer.

18. The garment of claim 17 wherein each guard member is supported in a pocket on the inner thigh area.

19. The garment of claim 18 wherein each guard member is non-removably supported within the pocket.

20. The garment of claim 19 wherein the garment is a pair of shorts made of flexible, elastic material.

* * * * *

US006161222C1

(12) EX PARTE REEXAMINATION CERTIFICATE (9962nd)

United States Patent

Strickland et al.

(10) Number: US 6,161,222 C1

(45) Certificate Issued: Nov. 26, 2013

(54) ATHLETIC GARMENT WITH INNER THIGH GUARDS

(75) Inventors: D. Chad Strickland, Midwest City, OK (US); Mark T. Cheatwood, Stillwater, OK (US)

(73) Assignee: Titan Holdings, LLC, Stillwater, OK (US)

Reexamination Request:
No. 90/011,908, Oct. 3, 2011

Reexamination Certificate for:

| | |
|---|---|
| Patent No.: | **6,161,222** |
| Issued: | **Dec. 19, 2000** |
| Appl. No.: | **09/415,324** |
| Filed: | **Oct. 8, 1999** |

(51) Int. Cl.
*A41D 1/00* (2006.01)

(52) U.S. Cl.
USPC ..... 2/228; 2/238; 2/455; 2/456; 2/466

(58) Field of Classification Search
None
See application file for complete search history.

(56) References Cited

To view the complete listing of prior art documents cited during the proceeding for Reexamination Control Number 90/011,908, please refer to the USPTO's public Patent Application Information Retrieval (PAIR) system under the Display References tab.

*Primary Examiner* — Catherine S. Williams

(57) ABSTRACT

An athletic garment with protective guard members on the inner thighs. The garment preferably will be compression shorts or pants. The guard members are supported in pockets formed on the inside of each thigh portion of the shorts. The guard member preferably is adapted to both deflect impacts and to absorb shock from impacts, particularly from balls in sports such as baseball. The guard member preferably is formed of an inner flexible, hard plastic deflective layer and an outer flexible, shock absorbing foam layer. Thus, the garment of this invention is particularly suited for use by a baseball catcher and the other infielders, but will be useful to athletes in any sport. This protective garment will reduce the discomfort and injury caused by the impact of a ball or other equipment or objects employed in virtually any sports activity.

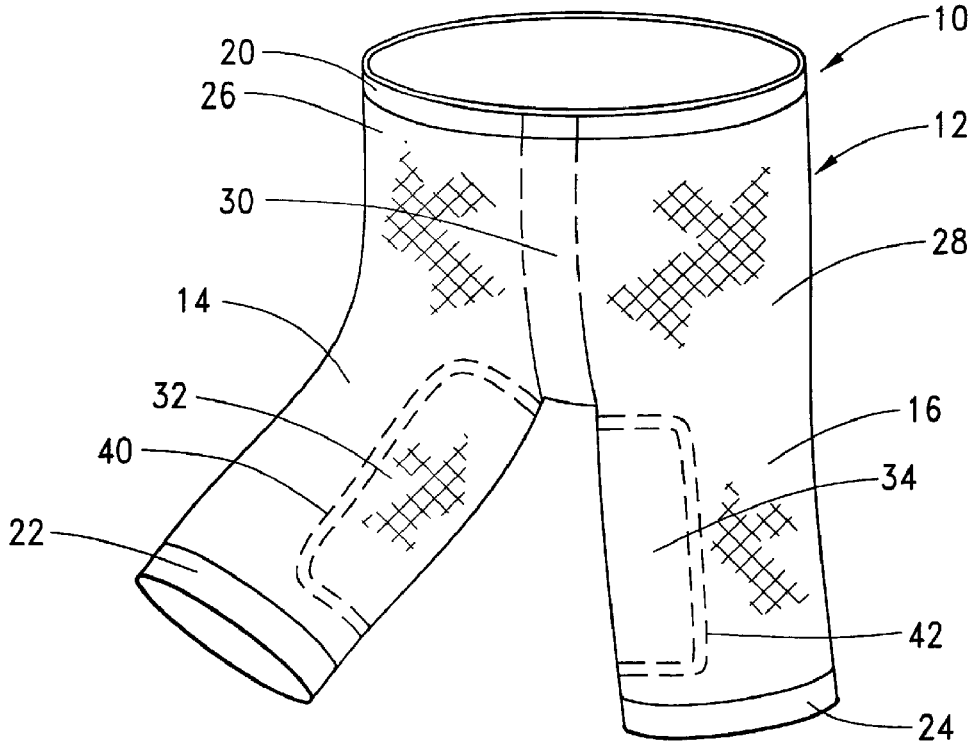

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-20 are cancelled.

New claims 21-33 are added and determined to be patentable.

*21. The garment of claim 1 further comprising a crotch portion between the respective thigh portions to substantially cover the crotch of the wearer, wherein the pair of guard members are separate padded sections that do not extend to the crotch portion.*

*22. The garment of claim 21 wherein the crotch portion is a layer of elastic material without a layer of padding affixed thereto.*

*23. The garment of claim 1 wherein the garment is a pair of compression shorts adapted to be worn under an athletic uniform, the guard members characterized as discrete sections of padding that protect the inner thighs of the person from ball impacts while engaged in an athletic contest, the garment further comprising an unpadded portion of elastic material positioned between the inner thighs of the person and the person's groin area.*

*24. The garment of claim 1 wherein the pair of guard members are characterized as a first guard member arranged to protect the inner thigh of the left leg of the person and an identical second guard member arranged to protect the inner thigh of the right leg of the person, each of the first and second guard members having an upper end terminating below a crotch portion.*

*25. The garment of claim 1 wherein the guard members are two substantially rectangular sections of padding adapted to respectively protect the inner thighs of a baseball catcher from an impact of a baseball as the baseball catcher squats with knees apart in a fundamental ready position behind a plate.*

*26. The garment of claim 1 wherein the pair of guard members are two separate sections of padding that do not extend to a groin area of the garment in order to facilitate the person squatting in a fundamental ready position of a baseball catcher.*

*27. An athletic garment for a person having adjacent inner thighs, the garment comprising:*

*a body including a pair of thigh portions each with an inner thigh area; and*

*a pair of guard members, one supported by each of the inner thigh areas and positioned to substantially cover the adjacent inner thighs of the wearer when the garment is worn, wherein the guard members are substantially flush with the garment and are separate padded sections that do not extend to a crotch portion of the garment between the thigh portions, and wherein the inner thigh areas of the garment comprising the guard members are not substantially thicker than the remainder of the thigh portions of the garment.*

*28. The garment of claim 27 characterized as a pair of compression shorts adapted to be worn under an athletic uniform to protect the the inner thighs of the person from a ball impact during engagement in an athletic contest.*

*29. The garment of claim 27 wherein the guard members are two substantially rectangular sections of padding adapted to respectively protect the inner thighs of a baseball catcher from an impact of a baseball as the baseball catcher squats with knees apart in a fundamental ready position behind a plate.*

*30. The garment of claim 27 wherein the pair of guard members are formed of a deflective layer to deflect a ball upon impact and a shock absorbing layer to absorb force during said impact.*

*31. The garment of claim 27 characterized as a pair of shorts and the pair of guard members are adapted to be not removable from the pair of shorts.*

*32. The garment of claim 27 characterized as a pair of shorts to be worn by a baseball catcher under a baseball uniform to facilitate squatting by the catcher behind a plate into a knees apart, fundamental ready position to receive a baseball thrown toward said plate, the pair of guard members constituting two discrete areas of padding to protect the inner thighs of the catcher from an impact from said baseball.*

*33. The garment of claim 27, in which the crotch portion is unpadded.*

* * * * *